US007026274B2

(12) United States Patent
Jenevein

(10) Patent No.: US 7,026,274 B2
(45) Date of Patent: Apr. 11, 2006

(54) CLEANING COMPOSITION FOR NEUTRALIZING BIOLOGICAL AND CHEMICAL WEAPONS REMOVAL AGENTS

(76) Inventor: Earl Jenevein, P.O. Box 1000, Robert, LA (US) 70455

( * ) Notice: Subject to any disclaimer, the term of this patent is extended or adjusted under 35 U.S.C. 154(b) by 0 days.

(21) Appl. No.: 10/610,032

(22) Filed: Jun. 30, 2003

(65) Prior Publication Data

US 2004/0110649 A1 Jun. 10, 2004

Related U.S. Application Data

(63) Continuation-in-part of application No. 10/351,880, filed on Jan. 27, 2003, which is a continuation-in-part of application No. 10/208,232, filed on Jul. 30, 2002, now Pat. No. 6,511,950.

(51) Int. Cl.
*C11D 1/645* (2006.01)
*C11D 3/43* (2006.01)
*C11D 3/30* (2006.01)

(52) U.S. Cl. ..... 510/110; 510/384; 510/391; 510/432; 510/480; 510/504

(58) Field of Classification Search ..... 510/110, 510/384, 391, 432, 480, 504
See application file for complete search history.

(56) References Cited

U.S. PATENT DOCUMENTS

| | | | | |
|---|---|---|---|---|
| 5,470,492 | A | 11/1995 | Childs et al. | |
| 5,476,599 | A | 12/1995 | Rusche et al. | |
| 5,503,756 | A | 4/1996 | Corona, III et al. | |
| 5,578,234 | A | 11/1996 | Corona, III et al. | |
| 5,929,026 | A | 7/1999 | Childs et al. | |
| 6,511,950 | B1 * | 1/2003 | Jenevein | 510/189 |

* cited by examiner

*Primary Examiner*—Charles Boyer
(74) *Attorney, Agent, or Firm*—Keaty Professional Law Corporation

(57) ABSTRACT

A cleaning composition for treating and removing stains from an object and for removing residue following a clean-up after a chemical or biological weapons attack. The composition uses ethanol, isopropyl alcohol, ethylene glycol mixed with one or more salts, such as bromides and chlorides, a chelator and a dispersant, mixed with water. The preferred salts are myristyltrimethylammonium bromide and benzethonium chloride, the chelator is tetrasodium salt ethylenediamine of tetraacetic acid, and the dispersant is polyvinyl alcohol.

15 Claims, No Drawings

CLEANING COMPOSITION FOR NEUTRALIZING BIOLOGICAL AND CHEMICAL WEAPONS REMOVAL AGENTS

CROSS-REFERENCE TO RELATED APPLICATIONS

This application is a continuation-in-part of my application Ser. No. 10/351,880, filed on Jan. 27, 2003, entitled "A Cleaning Composition," which is a continuation-in-part of application Ser. No. 10/208,232 filed on Jul. 30, 2002 entitled "A Cleaning Composition," now U.S. Pat. No. 6,511,950, the full disclosures of which are incorporated by reference herein.

BACKGROUND OF THE INVENTION

The present invention relates to a cleaning composition and, more particularly, to a composition for neutralizing agents used in removal of biological and chemical weapons and other substances from contaminated surfaces and objects.

Terrorist threats involving the use of weapons of mass destruction are increasing both in the United States and abroad. Considerable funds are expended by the United States and its allies in developing measures that would minimize or neutralize the contaminants that may be used in chemical or biological weapons.

The present invention is directed to a cleaning composition for neutralization of agents used in removal of chemical and biological weapons and decontamination of affected surfaces. The present invention is particularly directed to materials that can be delivered as sprays, liquids, and aerosols to facilitate neutralization and eventual removal of chemical compounds that have been applied to kill bacterial spores of the biological weapons or to decontaminate affected objects.

A chemical or biological weapon's attack can be carried out in a defined localized area or widely dispersed by vaporization, spraying and other methods in an effort to affect the largest possible number of military and civilians. The military, local and federal government must be prepared to deal with the decontamination task in an expeditious manner in order to return the civilian and military facilities to a safe status as soon as possible.

Scientists developed a number of decontamination agents suitable for neutralization of chemical warfare agents, such as nerve agents, blistering agents (such as mustard gas), phosphorus-containing compounds, such as sarin, soman, and tabun. These agents perform decontamination by substitution and oxidation reactions. Biological weapons decontamination agents involve antibacterial compounds capable of killing spores of the attack agent, for instance anthrax, botulinum toxin, and other spore-forming bacteria, vegetative bacteria, including plague and various viruses.

Most formulations developed for the decontamination of bioogical weapons contain the hypochlorite anion (i.e., bleach or chlorine-based solutions). Solutions containing concentrations of 5% or more bleach have been shown to kill spores. Aqueous concentrations of 2–6 percent of sodium hypochlorite, that is the strength of readily available household bleach, were shown to be effective in killing bacterial spores. Antibacterial agents may also contain higher concentrations of hypochlorite salts, in the range of 7–70 percent.

While these solutions demonstrated effective antibacterial qualities, they are also highly corrosive to equipment and toxic to humans. It would, therefore, be beneficial to remove the bleach and chlorine-based compounds immediately, or as soon as possible after, the agents have rendered the contaminated areas and surfaces free of bacterial spores.

The present invention contemplates provision of a cleaning composition that would effectively remove or neutralize agents used in chemical and bacterial weapons decontamination process.

SUMMARY OF THE INVENTION

It is, therefore, an object of the present invention to provide a cleaning composition that may be used in cleaning surfaces following decontamination of the surfaces from biological and chemical weapons.

It is another object of the present invention to provide a cleaning composition that exhibits deep penetrating and sanitizing qualities.

It is a further object of the present invention to provide a cleaning composition that is capable of removing oxidizing agents from objects and surfaces, while facilitating metal restoration.

These and other objects of the present invention are achieved through a provision of a saturated solution of a cleaning composition, which comprises alcohols, one or more quaternary ammonium salts, sulfates, chlorides or bromides. More specifically, the cleaning composition comprises ethanol, isopropyl alcohol, ethylene glycol n-hexylether, a bromide, such as myristyltrimethylammonium bromide and a chloride, such as benzethonium chloride.

The cleaning composition of the instant invention further comprises a chelator, such as for instance edetate sodium and more specifically, tetrasodium salt (tetrasodium edetate) of ethylenediamine tetraacetic acid (EDTA). The preferred embodiment further comprises a dispersant, such as for instance polyvinyl alcohol.

The active ingredients have between about 3% to about 4% of solids, between about 35% to about 38% of alcohol and water is added to make up 100% of volume. The total concentration of the active ingredients is preferably below 50% so as to make the composition easily miscible with water.

DETAILED DESCRIPTION OF THE PREFERRED EMBODIMENT

The present invention concerns with a cleaning composition that may be used for removal of antibacterial and other agents used in decontamination following bacterial and chemical weapons.

The cleaning composition of the present invention contains ethanol as the active ingredient. Ethanol (ethyl alcohol, grain alcohol) is a clear, colorless liquid. It is widely used as a fuel, as a solvent for products such as lacquers, paints, varnishes, glues, pharmaceuticals, explosives. Also as "building block" in making high-molecular-weight chemicals.

The cleaning composition of the present invention also comprises isopropyl alcohol. Isopropyl (isopropanol) is usually produced by hydration of propylene from cracked gases. It may be obtained as by-product of certain fermentation processes. Isopropyl alcohol is often used as a solvent for oils, gums, alkaloids, resins, in the production of acetone, soap, and antiseptic solutions.

Ethylene glycol used in the composition of this invention is a common glycol ether that may be produced by oxidation of ethylene to glycol or by hydrogenation of methyl glycolate made from formaldehyde and methanol. This alcohol is commonly used in deicing fluids, as antifreeze and brake fluid, in production of explosives. It is a good solvent for stains, oils, resins, enamels, inks, and dyes.

The cleaning composition further contains chlorides and bromides as the active ingredients. The bromides and chlorides are selected from the group consisting of myristyltrimethylammonium bromide, benzethonium chloride, PEG-6 lauramide, stearalkonium chloride, cocoamidopropylamine oxide, cetrimonium chloride. Other suitable salts may include one or more of the following: cetamine oxide, lauramine oxide, dipalmitoylethyl hydroxyethymmonium methusulfate, elalkonium chloride, lauramine oxide, myrystamine oxide, stearamin oxide, cocamidopropyl betaine, cetyl dimethyl betaine, hydrogenated cocamidopropyl betaine, laurylamidopropyl betaine, polyglyceryl-10 decaoleate propylene, propylene glycol/dicaprylate/dicaprate, caprylic/capric triglyceride, lauramide DEA, cocamide DEA, cocamide MEA, lauramide MEA, cocamide MIPA, coco diethanolamine, butoxy ethyl stearate, distearyl phthalic acide amide, di-hydrogenated tallow phthalic acid, sodium stearyl phthalamate. The cleaning composition of the instant invention further comprises a chelator, such as for instance edetate sodium and more specifically, tetrasodium salt (tetrasodium edetate) of ethylenediamine tetraacetic acid (EDTA). The preferred embodiment further comprises a dispersant, such as for instance polyvinyl alcohol.

The cleaning composition was tested using quaternary ammonium salts, more specifically myristyltrimethylammonium bromide and benzethonium chloride. The following description of the preferred embodiment refers to these salts, although it will be apparent to those skilled in the art that other salts, oxides, sulfates, chlorides and bromides may be used.

Myristyltrimethylammonium bromide, or N,N,N-Trimethyl-1-tetradecanamium bromide; trimethyltetradecylammonium bromide; tetradonium bromide is a cationic germicidal detergent, often used in disinfectant and deodorant compositions.

Benzethonium chloride, or N,N-Dimethyl-N-[2-[2-[4-(4-1,1,3,3-tetramethylbutyl) phenoxy]ethoxy]ethyl]benzenemethanaminium chloride; benzyldimethyl[2-[2-(p-1,1,3,3-tetramethylbutylphenoxy) ethoxy]ethyl]ammonium chloride is very soluble in water, producing a foamy, soapy solution. It is soluble in alcohol, acetone and chloroform. It is the compound's solubility in water and alcohol that became an important factor in selecting this salt for the cleaning composition of the present invention.

EDTA, which is used as a chelating agent, is N,N-1,2-Ethanediylbin[N(carboxymethyl)glycene]tetrasodium salt; (ethylenedinitrilo)retroacidic acid tetrasodim salt. It is usually sold as a powder, which is readily soluble in water.

Polyvinyl alcohol that is used in the most preferred embodiment is ethanol homopolymer. Some of the polyvinyl alcohols are soluble in hot and cold water; and some require a mixture of alcohol and water for solubility. Since the cleaning composition provides for the use of an aqueous solution of alcohol mixed with the active ingredients, polyvinyl alcohol is fully soluble at the pre-determined concentration.

The basic cleaning composition comprises ethanol, isopropyl alcohol, ethylene glycol n-hexylether, myristyltrimethylammonium bromide, benzethonium chloride dissolved in water. Optionally, the composition further comprises tetrasodium salt ethylenediamine tetraacetic acid (EDTA) and polyvinyl alcohol.

In the preferred embodiment, the cleaning composition comprises between about 35% and about 45% by volume of ethanol, between about 1.5% and about 2.5% by volume of isopropyl alcohol, between about 0.05% and about 0.5% by volume of ethylene glycol n-hexylether, between about 3% and about 4% by volume of benzethonium chloride, between about 3% and about 4% by volume of myristyltrimethylammonium bromide.

Optionally, the composition may also comprise between about 0.2% and 1% by volume of EDTA (tetrasodium) and between about 0.1% and 0.5% by volume of polyvinyl alcohol.

The following table provides a list of constituents in one embodiment of the formulation of the present invention and a range of ingredients that have been shown to effectively remove dirt and stains and is believed to be useful in removing residue of both chemical and biological weapons, in percent by volume, with water constituting the remainder volume to make 100%:

35%–45% ethanol 1.5%–2.5% isopropyl alcohol 0.05%–0.5% ethylene glycol n-hexylether 3%–4% myristyltrimethylammonium bromide 3%–4% benzethonium chloride 0.2% EDTA (tetrasodium)

0.1–0.5% polyvinyl alcohol

Another embodiment of the the formulation of the present invention and a range of ingredients is as follows:

35%–45% ethanol 1.5%–2.5% isopropyl alcohol 0.05%–0.5% ethylene glycol n-hexylether 3.5% myristyltrimethylammonium bromide 3.5% benzethonium chloride 1% EDTA (tetrasodium)

A third embodiment of the the formulation of the present invention and a range of ingredients is as follows:

35%–45% ethanol 1.5%–2.5% isopropyl alcohol 0.05%–0.5% ethylene glycol n-hexylether 3.5% myristyltrimethylammonium bromide 3.5% benzethonium chloride The preparation procedure of the cleaning composition of the present invention is relatively straightforward. First, the solids, containing salts, as well as chelator and dispersant, if used, are mixed in warm water (about 50 degrees Celsius) with stirring. Then alcohols are added, first—ethanol to a concentration of 35–45 by volume. Then, isopropyl alcohol and ethylene glycol n-hexylether are added and the mixture is stirred again to fully admix the ingredients.

In operation, the cleaning composition of this invention may be sprayed as an aerosol, or applied by wiping, or pouring on the surfaces that have been exposed to biological and chemical warfare. If necessary, an abrasive pad may be used for the relative degree of hardness of surfaces being cleaned, After wiping or mopping the surface, water may be applied to rinse and remove any residue.

The mechanism for the neutralizing of the anti-chemical and antibacterial agents that have been used in decontaminating of objects following chemical or biological attack by the formulation of the present invention is not well understood. It is believed that the key ingredients in the cleaning composition of the present invention are long chain, fatty alkyl quaternary ammonium compounds. They are efficient synthetic detergents,.which use the hydrophobic or non-polar "tails" of their long carbon chains to lift greasy substances from affected objects. In water, quaternary ammonium nitrogen at the end of the alkyl chain makes a polar site for anionic acid salts, proteins, and other synthetic polyanions to form an electrostatic bond as a salt. The amphipathic nature of the long chain quaternary ammonium salts also breaks the hydrogen bonded structure of water, effecting dispersion of dirt and fatty compounds in the lower surface tension of the water solvent.

The long chain fatty quaternary ammonium ions are made of modified tallow derivatives and are resistant to dispersion in water. The cleaning composition of the present invention, being based on alcohol, serves as a vehicle to promote a much greater dispersion of the lipophilic cationic surfactant (the quaternary amines) and penetration through tightly packed or polymerized dirt and stains.

Having penetrated through the surface grime and grease, the cleaning composition eventually reaches the agents used to decontaminate and kill chemical and bacterial weapons. Another component of the cleaning composition, the arminoacetic chelating agent, breaks up metal cation salts of hardened compounds. Additionally, the water soluble oxygenated polymers, which act as dispersing agents, for the entire mixture facilitate the penetration and neutralizing qualities of the cleaning composition.

The same qualities that make the cleaning composition of this invention effective in removing dirt and stains, facilitate the deep penetrating ability of the composition to remove dangerous contaminants from the surfaces and serve as an effective sanitizing agent in the event of biological warfare situation.

Although the formulation of the present invention composition is not a complete neutralizing agent for microbial species in the aftermath of biological warfare, the cleaner is effective in removing carrier solvents used as dispersants for gas attack agents or biological residue from all surfaces, particularly those that have been treated with an oxidizing agent, such as sodium hypochlorite.

It is envisioned that this cleaner may be applicable in a variety of situations, such as the decontamination of open, semi-enclosed, and enclosed facilities as well as sensitive equipment. The composition of this invention is believed to be effective in cleaning porous, non-porous surfaces, vehicles, furniture, flooring, building surfaces, and paved areas. The cleaning composition may act as a powerful bactericidal agent and used for sanitation of bathrooms, military barracks, and other such facilities. It is also envisioned that the cleaning composition may be used for surface cleaning of backpacks, weapons, eating utensils, tools, firearms that have been exposed to the fumes and toxic aerosols of a battle condition.

The cleaning composition of this invention may act as a metal restorer and polishing material. It may be applicable to maintenance of vehicles, work areas, machinery parts that are exposed to grease, oil, sand and caked dirt. At the same time, the composition is safe, it contains biodegradable materials and is non-polluting. Hence, it may find its application in the cleanup following oil field sabotage and destruction of pipelines, tanks, refineries, and oil depots through deliberate attempts at pollution.

Depending on the concentration and the active ingredients, the cleaning solution may be prepared for removing tough stains, dirt, grease, grime, protein-based stains, food stains and other stains.

The cleaning composition contains ingredients that may be easily rinsed away with water after the cleaning process has been completed. The resultant runoff is non-polluting and safe for the environment.

The formulation of this invention renders chemical and biological toxins and their removal agents harmless in a reasonable period of time, allowing rapid restoration of objects and surfaces to safe levels.

From the foregoing description, one skilled in the art can easily ascertain the essential characteristics of the invention defined in this specification and the appended claims, and without departing from the spirit and scope thereof can make various changes and modifications of the invention to adapt it to various usages and conditions. Such changes and modifications as would be obvious to one skilled in the art are intended to be included within the scope of the following claims.

I claim:

1. A cleaning composition comprising ethanol, isopropyl alcohol, ethylene glycol n-hexylether, myristyltrimethylammonium bromide, benzethonium chloride, the tetrasodium salt of ethylenediamine tetraacetic acid, and polyvinyl alcohol dissolved in water.

2. The cleaning composition of claim 1, wherein active ingredients are mixed with water at a concentration of about 38%.

3. The cleaning composition of claim 1, wherein said composition comprises between about 35% and 45% by volume of ethanol.

4. The cleaning composition of claim 1, wherein said composition comprises between about 1.5% and 2.5% of isopropyl alcohol.

5. The cleaning composition of claim 1, wherein said composition comprises between about 0.05% and 0.5% by volume of ethylene glycol n-hexylether.

6. The cleaning composition of claim 1, wherein said composition comprises between about 3% and 4% by volume of each myristyltrimethylammonium bromide and benzethonium chloride.

7. The cleaning composition of claim 1, wherein said composition comprises between about 0.2% and 1% by volume of the tetrasodium salt of ethylenediamine tetraacetic acid, and between about 0.1% to about 0.50% by volume of polyvinyl alcohol.

8. The cleaning composition of claim 1, comprising:

between about 35% and 45% by volume of ethanol, between about 1.5% and 2.5% by volume of isopropyl alcohol, between about 0.05% and 0.5% by volume of ethylene glycol n-hexylether, between about 3% and 4% by volume of each myristyltrimethylammonium bromide and benzethonium chloride, between about 0.2% and 1% by volume of the tetrasodium salt of ethylenediamine tetraacetic acid, and between about 0.1% to about 0.50% by volume of polyvinyl alcohol, mixed with water.

9. A method of treating stains on an object, the method comprising the steps of:

applying to the stained surface a pre-determined amount of a cleaning composition according to claim 1 wherein the concentration of active ingredients is about 38% by volume.

10. The method of claim 9, wherein said mixture comprises between about 35% and 45% by volume of ethanol, between about 1.5% and 2.5% by volume of isopropyl alcohol, between about 0.05% and 0.5% by volume of ethylene glycol n-hexylether, between about 3% and 4% by volume of each myristyltrimethylammonium bromide and benzethonium chloride.

11. The method of claim 9, wherein said mixture comprises between about 0.2% and 1% by volume of tetrasodium salt of ethylenediamine tetraacetic acid, and between about 0.1% to about 0.50% by volume of polyvinyl alcohol.

12. The method of claim 9, further comprising the step of rinsing the object with water to remove the mixture and residue from the treated object.

13. A method of removing residue from an object following a clean-up after a chemical or biological weapons attack, the method comprising the steps of:

applying an effective amount of the cleaning composition according to claim 1 wherein the concentration of active ingredients is about 38% by volume.

14. The method of claim 13, further comprising the step of rinsing the object with water to remove the mixture and residue from the treated object.

15. The method of claim 13, wherein said mixture comprises between about 35%, and 45% by volume of ethanol , between about 1.5% and 2.5% by volume of isopropyl alcohol, between about 0.05% and 0.5% by volume of ethylene glycol n-hexylether, between about 3% and 4% by volume of each myristyltrimethylammonium and benzethonium chloride, between about 0.2% and 1% by volume of the tetrasodium salt of ethylenediamine tetraacetic acid, and between about 0.1% to about 0.50% by volume of polyvinyl alcohol.

* * * * *